United States Patent [19]

Takenaka et al.

[11] 4,043,718

[45] Aug. 23, 1977

[54] SPINNING APPARATUS WITH RETRACTABLE SUCTION GUN

[75] Inventors: Yoshisuke Takenaka; Kikuo Hori, both of Matsuyama, Japan

[73] Assignee: Teijin Limited, Osaka, Japan

[21] Appl. No.: 618,007

[22] Filed: Sept. 30, 1975

[30] Foreign Application Priority Data

Oct. 3, 1974 Japan ..... 49-113290
Oct. 3, 1974 Japan ..... 49-113291

[51] Int. Cl.[2] ..... D01D 7/00

[52] U.S. Cl. ..... 425/72 S; 242/54 R; 302/2 R; 425/216

[58] Field of Search ..... 425/72 S, 215, 216; 242/18 DD, 54 R, 77; 302/36, 58, 2 R

[56] References Cited

U.S. PATENT DOCUMENTS

| | | | |
|---|---|---|---|
| 2,533,432 | 12/1950 | Clark | 242/77 X |
| 2,979,766 | 4/1961 | Briggs et al. | 425/72 S |
| 3,720,382 | 3/1973 | Lehner | 425/72 S X |
| 3,902,833 | 9/1975 | Matovinovic | 425/72 S X |

FOREIGN PATENT DOCUMENTS

| | | | |
|---|---|---|---|
| 2,133,172 | 1/1972 | Germany | 242/18 DD |
| 143,196 | 3/1961 | U.S.S.R. | 425/72 S |

*Primary Examiner*—Robert D. Baldwin
*Attorney, Agent, or Firm*—Kenyon & Kenyon

[57] ABSTRACT

In a spinning apparatus for producing synthetic threads providing with at least one spinning unit comprising a spinneret, a spinning duct disposed below the spinneret and a take-up device mounted on a base floor below the spinning duct, wherein a work space for carrying out the threading operation is provided in front of the take-up device, a hand-held suction gun for taking up a thread at the time of the threading operation is installed in the above-mentioned threading space. A compressed air supply conduit connected to the suction gun and a conduit for exhaust air from the suction gun are held in a container in such a condition that they are capable of being freely pulled out therefrom and pulled thereinto. An upper floor is arranged above the base floor so as to provide an operating workspace at a position in front of the spinning duct in such a condition that the operating workspace on the upper floor and the threading workspace on the base floor are arranged at opposite sides with respect to a thread passage formed between the spinneret and the take-up device.

7 Claims, 2 Drawing Figures

SPINNING APPARATUS WITH RETRACTABLE SUCTION GUN

BACKGROUND OF THE INVENTION

This invention relates to a spinning apparatus. More particularly, the invention relates to a spinning apparatus that greatly improves the working efficiency of all of the operational steps from spinning to winding.

Thread treating speeds have recently been increased to meet requests for improved productivity. In the art of manufacturing filaments or yarns of thermoplastic synthetic filaments such as polyester and polyamide filaments, there have been developed techniques of obtaining highly oriented excellent filaments characterized by a large reduction in the number of changes in quality with the lapse of time, compared to previous techniques, by increasing the spinning speeds in the melt-spinning process. Accordingly, thread treating speeds have now been increased to as much as 2000 m/min or higher, and on special occasions, 2500 m/min or higher.

Spinning, winding or other treatment of thread running at such high speed can not be accomplished by conventional treating equipment, the maximum yarn treating speed of which is about 1500 or 1600 m/min. In order to adapt said conventional equipment to treat high speed-running thread, various improvements on the equipment must be carried out.

For example, in the case of a winding apparatus, in order to wind thread delivered at a high speed, it is necessary to provide means for strongly gripping and holding the end of the thread without fail to prevent the winding of the thread onto feed rollers if the thread breaks and also to tranfer the thread from a full bobbin to an empty bobbin during the bobbin exchange step. One such gripping means, which has heretofore been used, is an aspirator disposed at a predetermined position to suck and hold thread by the action of compressed air fed to the aspirator. However, as the thread treating speed is further increased, it becomes difficult for such an aspirator disposed at a predetermined fixed position to follow thread running at a high speed. Accordingly, a suction gun having a structure similar to that of the aspirator but being moved freely by hand has been used instead of the fixed aspirator. This suction gun, however, is unwieldy, making the yarn hanging operation very difficult to perform, because a bag for containing sucked waste threads therein is mounted integrally to the suction gun. As a means for overcoming this disadvantage, there has been proposed a method in which waste threads sucked by the suction gun are delivered to a means for containing the waste thread through an exhaust conduit.

While various improvements and modifications have been made to suction guns for sucking yarns by the action of compressed fluid, no particular consideration has been given to the arrangement of a supply conduit for introducing the compressed fluid into the gun proper or to an exhaust conduit for introducing sucked thread into said waste thread containing means. These conduits are generally laid on the floor, and a great amount of labor is required in the handling of the suction gun. In addition, since these conduits are readily bent in a complicated manner while the threading operation is conducted by using the suction gun, passage resistances are changed in these feed and exhaust conduits, which causes a great change in the yarn sucking capacity of the suction gun and reduces the rate of success in the threading operation. Moreover, if various conduits are laid on the floor as mentioned above, they get in the way of the operator, and the available working space is drastically reduced. Working under such conditions in the vicinity of a yarn winding apparatus rotated at a very high speed is very dangerous and causes problems concerning the working environment and the like.

In conventional spinning and take-up apparatuses, in order to facilitate such operations as inspection and cleaning of the operation face of the thread take-up device and the spinneret face, taking-out of thread from the spinneret face, and the operation of passing thread delivered from a spinneret through a spinning cylinder (all of which will whereinafter be referred to as "the manual operation for spinning"), the work space for the manual operation for spinning is positioned on the same side of the thread passage as the work space for the threading operation. Accordingly, spinning and take-up devices in which all of the operations can be performed at a high rate of efficiency has not yet been developed.

SUMMARY OF THE INVENTION

It is therefore a primary object of this invention to solve the above mentioned problems involved in the conventional techniques by providing adjacent air supply and exhaust conduits, connected to a hand-held aspirating type of suction gun for sucking thread by the action of compressed fluid, which are capable of freely advancing and retracting.

Another object of this invention is to improve the working efficiency of threading operation by locating both a means for containing the above mentioned conduits and a box for containing waste threads above the threading operation work space space of the suction gun.

Still another object of this invention is to improve the working efficiency of the threading operation and perform the above-mentioned various operations using a spinning apparatus comprising a yarn take-up device on a machine installing floor or base floor and a spinning cylinder disposed above the yarn take-up device, by providing an upper floor above the machine installing floor to support the spinning cylinder, the part of the machine installing floor in front of the yarn take-up device is designated as a first work space for carrying out the thread take-up operation, the part of the upper floor in front of the spinning cylinder is designated as a second work space for carrying out the manual operation for spinning, and the first and second work spaces are disposed so as to confront each other with a thread passage interposed therebetween.

Other objects, features and advantages of this invention will be apparent from the following detailed description with reference to the accompanying drawings.

DETAILED EXPLANATION OF THE INVENTION

Figure 1:
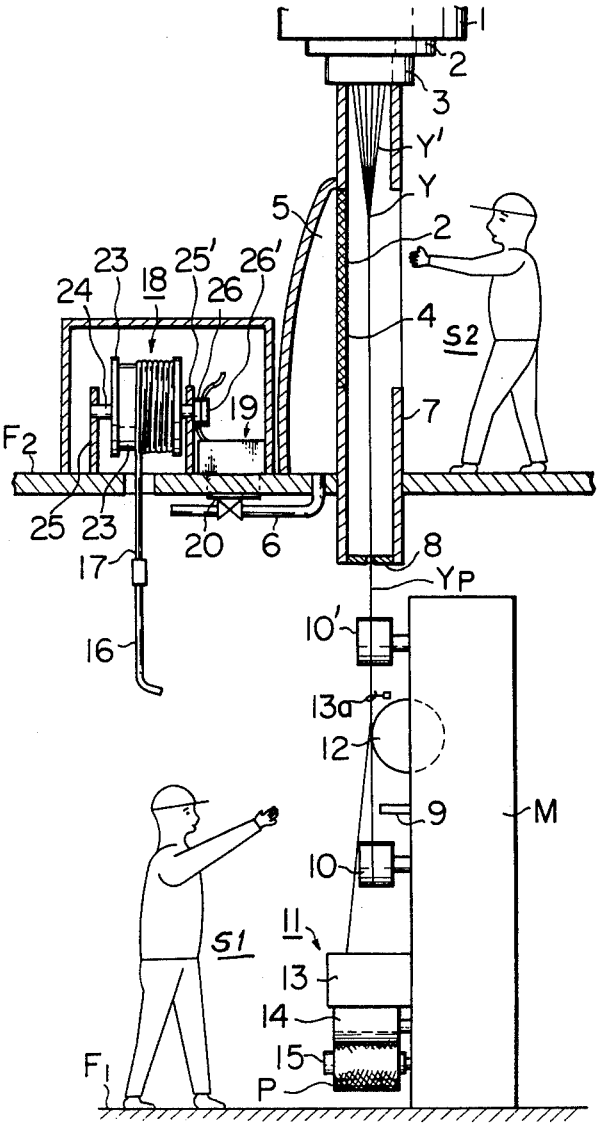
FIG. 1 is a front view of a first embodiment of this invention.

Referring now to FIG. 1, a stream of a molten polymer is received by a spinning block 1 and is extruded as a filamentary flow Y' through a pack 2 and a spinneret 3. The filamentary stream Y' is cooled and solidified to a thread Y by cooling air in a cooling chamber 4. Said cooling air is fed into this cooling chamber 4 from a cooling air feed duct 5 through an air feed conduit 6. Said spinning block 1, pack 2, spinneret 3 and cooling zone 4 are disposed on an upper floor $F_2$, which is higher by one floor than a base floor $F_1$ on which a winding device is installed. A spinning cylinder 7 is supported on this upper floor $F_2$ and it has a collection guide 8. Provision of this collection guide 8 may be omitted, or it may be mounted outside the spinning cylinder 7.

A yarn take-up device M is installed on the base floor or machine installing floor $F_1$, and an aspirator 9, godet rollers 10 and 10' and a winding device 11 are mounted on the take-up device M. In addition, a yarn cutter and a member for detecting trouble such as yarn breakage may be mounted in the vicinity of the winding device 11 according to need.

An oiling roller 12 is disposed so as to apply a wetting agent, for example, an oiling agent, to the thread. A spray or the like may be used instead of this oiling roller 12. The winding device 11 comprises a traverse mechanism 13 and a friction roller 14, and is provided with a winding bobbin 15, all of which are disposed below a traverse fulcrum guide 13*a.* Reference numeral 16 denotes a suction gun to which a flexible dual channel conduit 17 is connected for air feeding and air exhaust. This conduit 17 is contained in a conduit container 18 and can optionally be freely taken out from the container 18 when the suction gun is used. Waste threads sucked by the action of compressed fluid are gathered in a waste thread box 19. The bottom 20 of the box 19 can be freely opened so as to discharge waste threads therefrom when the box 19 becomes filled with waste threads.

Any of the known suction guns used in this field may be employed as the suction gun 16 as long as it has an aspirating action such that yarns are sucked by the action of compressed fluid, for example, compressed air. The conduit container 18 comprises a drum 23, a shaft 24 fixed to the drum 23 and a pair of brackets 25 and 25' which pivotally support the shaft 24. As pointed out above, the conduit 17 includes a compressed air feed channel and an exhaust channel for delivering sucked waste threads together with exhaust air. The respective channels pass through introduction holes perforated through the interior of the shaft 24 and are connected to the outside through rotary valves 26 and 26'. More specifically, the compressed air feed channel is connected to a compressed air supply source (not shown) and the exhaust channel is connected to a waste thread reservoir 19. A spiral spring (not shown) is disposed inside the drum 23, so that when the drum 13 is rotated in a direction so as to pull out the conduit 17, the spring is urged and rotates the drum 23 in the reverse direction so as to restore it to the original position when the conduit 17 is set free.

The suction gun 16 is operated in such a manner that it faces the winding device and the other means, and the conduit container 18 and waste thread box 19 are disposed above the work space of the suction gun, namely on the upper floor $F_2$ higher by one floor than the floor $F_1$ of the winding chamber.

The area of the machine installing floor $F_1$ in front of the yarn take-up device M is designated as a first work space, that is, a yarn take-up operation work space $S_1$ and the part of the upper floor $F_2$ in front of the spinning cylinder 7 is designated as a second work space, that is, a spinning-out operation work space $S_2$. These first and second work spaces are disposed so as to confront each other with a yarn passage $Y_p$ interposed therebetween.

During the yarn take-up operation, one worker stands at the first work space $S_1$ and another worker stands at the second work space $S_2$. First, the worker at the work space $S_2$ performs the manual operation for spinning, and, then, the worker at the work space $S_1$ receives a thread fed downwardly from the spinning cylinder and by means of the suction gun hangs the thread on the yarn take-up device. In this manner, the theading operation can be performed without interruption.

In the embodiment illustrated in FIG. 1, when the suction gun is used for the threading operation or the like, the suction gun is pulled downwardly from above and set at a prescribed position to catch the thread end. The passage resistance of the conduit 17 connected to the suction gun 16 is slightly changed even when an arrangement as shown in FIG. 1 is carried out. This change is due to the fact that the angle at which the conduit 17 is wound on the drum 23 is changed depending on the setting position of the suction gun 16. However, this change of the passage resistance in the conduit 17 is very small and within an estimable range, and if the sucking force of the suction gun is appropriately chosen in advance, no particular disadvantage or trouble is brought about by this change of the passage resistance in the conduit 17.

When the suction gun 16 is not used, it is stored above the threading operation work space on the machine installing floor $F_1$, where it does not interfere with the threading operation and the like. Therefore, operations such as the threading operation can be performed rapidly and with assurance, and the working danger can be greatly reduced. Further, even when the operation of doffing a package from the yarn take-up device is performed automatically by means of an auto-doffer, the suction gun 16 does not hinder the running of the autodoffer, and good results can be obtained effectively and conveniently.

Another embodiment of this invention will now be illustrated with reference to FIG. 2.

Figure 2:
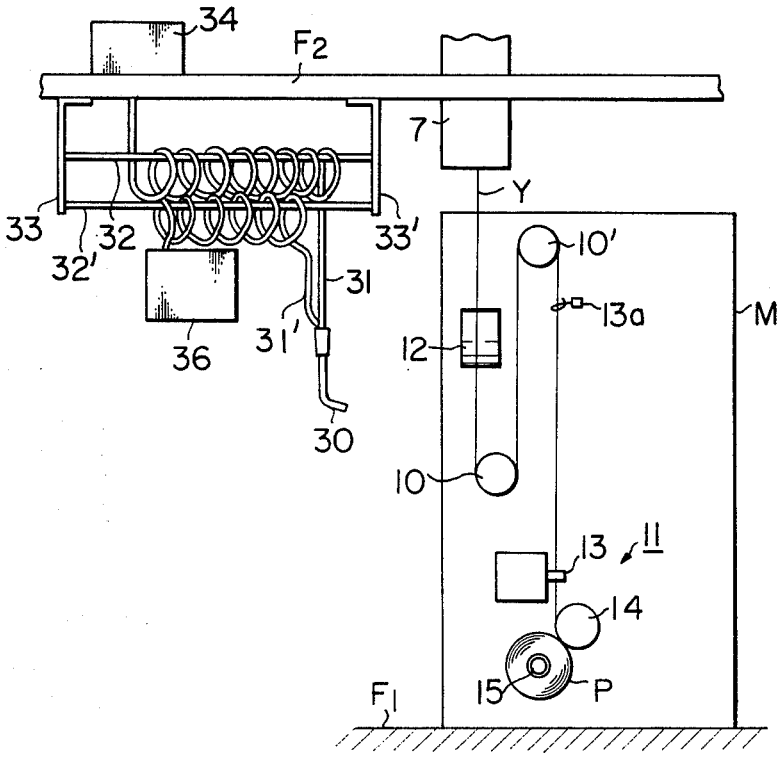
FIG. 2 is a side view of another embodiment of this invention.

In FIG. 2, the lower ends of an air feed conduit 31 and an exhaust conduit 31' are connected to a suction gun 30. These conduits, which are composed of a flexible material hang in a coiled state from adjacent parallel bars 32 and 32' extending between a pair of brackets 33 and 33' above the threading work space 51. The upper end of the feed conduit 31 is connected to a compressed air supply source 34 and the upper end of the exhaust conduit 31' is connected to a waste thread reservoir 36.

In this embodiment, the suction gun 30 is positioned so as to face the take-up device, and when the suction gun 30 is pulled downwardly, the flexible coily conduits are stretched. In this state, the above-mentioned treatment is performed by using the suction gun 30. When the suction gun 30 is set free after the treatment, the conduits are returned to the original positions by virtue of the flexibility of the coily portions thereof, if necessary auxiliary springs may used.

In this invention, it is possible to adopt a layout where a guide is disposed substantially horizontally above the space for carrying out the threading operation to guide a compressor for supplying compressed air to the suction gun through the feed conduit and means for containing waste threads therein delivered from the suction gun through the exhaust conduit, so that the compressor and waste thread containing means are moved horizontally along this guide. By this arrangement, the length of the compressed air feed conduit and the exhaust conduit may be shortened. In the above-mentioned embodiment, it is also effective to arrange either one of the compressor and the waste thread box in movable condition.

In the apparatus of this invention, the conduit of the suction gun is pulled out only by a length necesssary for the operation when the suction gun is used for the thread treatment. Accordingly, the drawback of the conventional apparatus, that the conduit is laid randomly on the operation floor and hinders the operation, can be eliminated completely in this invention. Further, even if a conduit having a large diameter to increase the suction force is employed as the suction gun conduit, there is no hindrance to the operation, and deformation of the conduit can be reduced within an estimable range. Accordingly, the change in the passage resistance can be greatly reduced in the conduit, and the loss of the thread sucking performance can be lowered without any trouble. Consequently, the thread can be gripped with certainty and the success rate in the threading operation can be highly improved. As a result the frequency of repetition of the threading operation can be greatly reduced, which in turn reduces the amount of labor required is repetition of the threading operation as well as the loss of waste threads formed by the threading operation.

What is claimed is:

1. In a spinning apparatus for producing synthetic threads provided with at least one spinning unit including a spinneret for extruding a filamentary stream, a spinning duct below the spinneret for receiving said filamentary stream, a cooling chamber formed into said spinning duct for cooling and solidifying said filamentary stream into a thread, a take-up device mounted on a base floor below said spinning duct, a first work space for threading said thread onto the take-up device being provided on the base floor in front of said take-up device, and a hand-held aspirating type of suction gun disposed in said first work space for taking up the free end of said thread, an improvement comprising means located adjacent to the first work space for retractably retaining a conduit for supplying compressed air into said suction gun and a closely adjacent conduit for carrying exhaust air and waste threads from said suction gun in such a condition that said conduits are capable of being freely pulled out therefrom.

2. An improvement of a spinning apparatus according to claim 1, further comprising means for receiving waste threads carried together with exhaust air through said exhaust conduit, said receiving means connected to a downstream end of said exhaust conduit, said conduit retaining means and waste thread receiving means being disposed over said first work space.

3. An improvement of a spinning apparatus according to claim 2, further comprising an upper floor positioned above said base floor, said upper floor being utilized for manually carrying out spinning operations at a position above said take-up device, a second work space for carrying out said spinning operation being provided on said upper floor on the opposite side of said spinning duct from the first work space on the base floor.

4. An improvement of a spinning apparatus according to claim 3, wherein said conduit retaining means and said waste thread receiving means are mounted on said upper floor over said first work space.

5. An improvement of a spinning apparatus according to claim 3, wherein said conduit retaining means and said waste thread receiving means are disposed at a position beneath said upper floor.

6. An improvement of a spinning apparatus according to claim 2, further comprising a compressor connected to the supply conduit for delivering said compressed air to the suction gun, and wherein said conduit retaining means includes means for guidably supporting said compressor and said waste thread receiving means disposed at a position above said base floor for displacement in a horizontal direction toward and away from said first work station.

7. An improvement of a spinning apparatus according to claim 1, further comprising an upper floor positioned above said base floor, said upper floor being utilized for manually carrying out spinning operations at a position above said take-up device, a second work space for carrying out said spinning operations being provided on said upper floor, said threading first work space in front of said take-up device and said spinning second work space being arranged at opposite sides of a passage of threads formed between said spinneret and said take-up device.

* * * * *